US006274849B1

(12) United States Patent
Paybarah

(10) Patent No.: US 6,274,849 B1
(45) Date of Patent: Aug. 14, 2001

(54) RADIANT ELECTRIC HEATER

(75) Inventor: Ali Paybarah, Droitwich (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/482,236

(22) Filed: Jan. 13, 2000

(30) Foreign Application Priority Data

Jan. 22, 1999 (GB) ..... 9901398

(51) Int. Cl.[7] ..... H05B 3/68
(52) U.S. Cl. ..... 219/461.1
(58) Field of Search ..... 219/461.1, 460.1, 219/451.1, 452.11, 452.12; 126/39 J, 39 H, 90 A, 92 AC, 92 A, 92 B

(56) References Cited

U.S. PATENT DOCUMENTS 3,627,986 * 12/1971 Anderson ..... 219/452.12
3,632,983 * 1/1972 Dills ..... 219/452.12
4,150,280 * 4/1979 Hurko ..... 219/452.12
4,251,716 * 2/1981 Lewis et al. ..... 219/445.1
4,264,805 * 4/1981 Traut ..... 219/452.12
5,512,731 * 4/1996 McWilliams ..... 219/461.1

* cited by examiner

*Primary Examiner*—Sang Paik
(74) *Attorney, Agent, or Firm*—Ira S. Dorman

(57) ABSTRACT

A radiant electric heater comprises a dish-like component (1) of thermal insulation material having a base (2) and an upstanding peripheral wall (3). At least one heating element (4) is supported inside the dish-like component, and reinforcing means (5) is secured to the outside of the dish-like component at the outside thereof. The reinforcing means (5) comprises at least one strip (6, 7; 6A, 7A) extending across the base (2) and at least partly up the peripheral wall (3) of the dish-like component (1).

18 Claims, 2 Drawing Sheets

RADIANT ELECTRIC HEATER

FIELD OF THE INVENTION

This invention relates to radiant electric heaters which find particular application in cooking appliances such as glass-ceramic cooking appliances.

DESCRIPTION OF PRIOR ART

It has been well known for many years to produce radiant electric heaters for glass-ceramic cooking appliances in which a layer of insulation material, particularly microporous insulation material, is provided in a reinforcing means in the form of a metal dish. A heating element is supported on or adjacent to the insulation layer and a peripheral wall of insulation material is provided against the inside of the side edge of the dish. A terminal block, for connecting the heating element to a voltage supply, is usually provided secured to a side edge of the dish.

A temperature limiting device is also usually provided, secured to the dish and having a rod-like portion extending at least partly across the heater, over the heating element.

In order to save costs, it has previously been proposed to dispense with the metal dish and provide a dish-like component of thermal insulation material inside which at least one heating element is supported. For maximum thermal efficiency it is preferred that the dish-like component should comprise compacted microporous insulation material. However, such material is relatively soft and the dish-like component may be relatively fragile. Furthermore it is difficult to secure a terminal block and a temperature limiting device thereto.

OBJECT OF THE INVENTION

It is an object of the present invention to overcome or minimise these problems.

SUMMARY OF THE INVENTION

According to the present invention there is provided a radiant electric heater comprising a dish-like component of thermal insulation material having a base and an upstanding peripheral wall, at least one heating element supported inside the dish-like component, and reinforcing means secured to the dish-like component at the outside thereof, wherein the reinforcing means comprises at least one strip extending across the base and at least partly up the peripheral wall of the dish-like component.

The at least one strip may have opposite ends thereof extending at least partly up the peripheral wall.

The reinforcing means may comprise at least two strips extending at an angle to one another across the base and at least partly up the peripheral wall of the dish-like component. The at least two strips may be arranged substantially orthogonal to one another. The at least two strips may be provided as separate components crossing one another and/or secured to one another, or may be provided as limbs of a single integral component.

A terminal block and/or a temperature limiting device may be secured to the reinforcing means and suitably to one or more portions of the at least one strip thereof which extend at least partly up the peripheral wall.

The at least one strip of the reinforcing means may be secured to the dish-like component at the peripheral wall thereof. Such securing may be by means of a deformed portion, for example a cut out deformed portion, of the at least one strip extending towards (into or over) the peripheral wall.

The at least one strip of the reinforcing means may incorporate at least one stiffening rib, which may run longitudinally along the at least one strip.

The reinforcing means may comprise metal.

The thermal insulation material of the dish-like component may comprise compacted microporous thermal insulation material.

For a better understanding of the present invention and to show more clearly how it may be carried into effect reference will now be made, by way of example, to the accompanying drawings in which:

DESCRIPTION OF PREFERRED EMBODIMENTS

Figure 1:
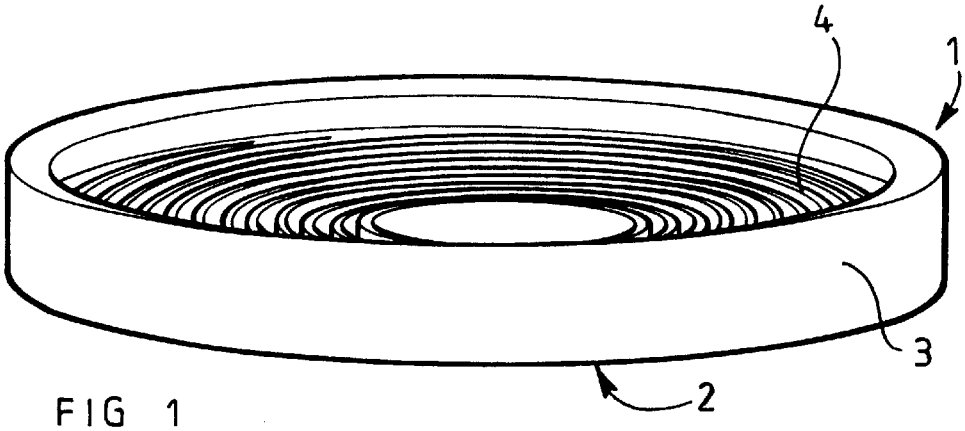
FIG. 1 is a perspective view of a dish-like component of thermal insulation material having at least one heating element supported therein for use in a radiant electric heater according to the present invention.
Figure 2:
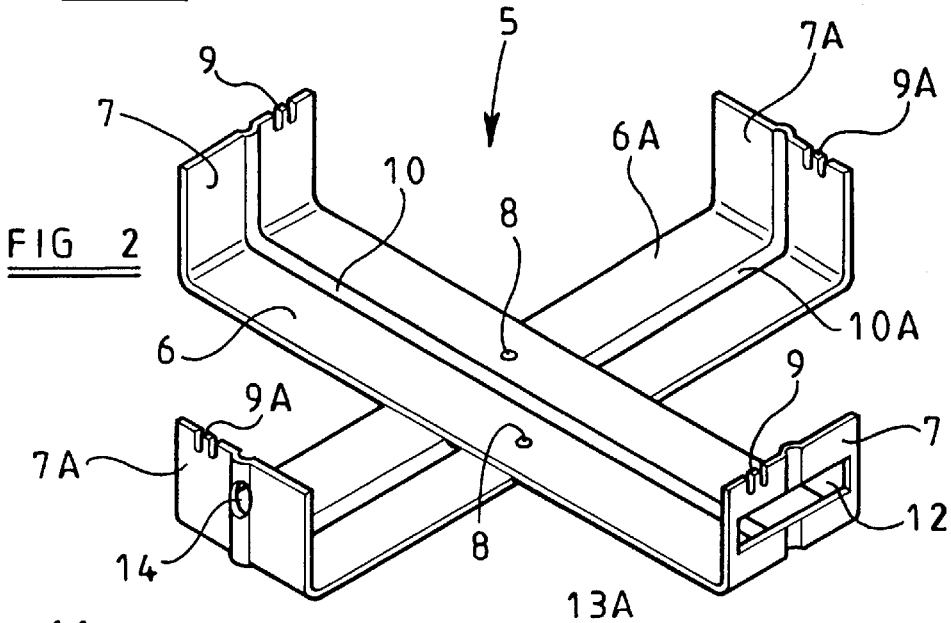
FIG. 2 is a perspective view of one embodiment of reinforcing means for application to the dish-like component of FIG. 1.

Referring to the drawings, a radiant electric heater is provided which finds particular application mounted beneath a glass-ceramic surface in a cooking appliance (not shown).

The heater comprises a dish-like component 1 of thermal insulation material, the dish-like component having a base 2 and an upstanding peripheral wall 3. The dish-like component is suitably of moulded form produced by compacting particulate microporous thermal insulation material in an appropriately-shaped press tool. Microporous insulation material compositions and moulding techniques suitable for this purpose are well known to the skilled person.

By way of example, the microporous insulation material may comprise:

| | |
|---|---|
| Pyrogenic silica | 49–97% by weight |
| Glass or ceramic fibre reinforcement | 0.5–20% by weight |
| Opacifier (e.g. titanium dioxide) | 2–50% by weight |
| Alumina | 0.5–12% by weight |

At least one heating element 4 is provided, supported inside the dish-like component 1. The heating element or elements 4 may comprise any of the well known forms, such as coiled wire, metal ribbon, or lamp forms, or combinations thereof. In the illustrated embodiment, the heating element 4 is a corrugated ribbon partially embedded edgewise in the upper surface of the base 2 of the dish-like component 1.

The dish-like component is relatively fragile. Reinforcing means 5 is therefore provided, secured at the outside of the dish-like component 1.

The reinforcing means 5 comprises at least one metal strip, such as of steel, having a portion 6 extending across and in contact with the outside of the base 2 of the dish-like component 1, and one or more portions 7 extending at least partly, and preferably completely, up the outside of the peripheral wall 3.

A further such metal strip may be provided at an angle to the first-mentioned strip and comprising portions 6A and 7A similar to the portions 6, 7 of the first strip.

The two metal strips 6, 7; 6A, 7A are suitably arranged substantially orthogonally to one another. They may be secured together, such as by welds 8, at a region where they cross one another.

Figure 4:
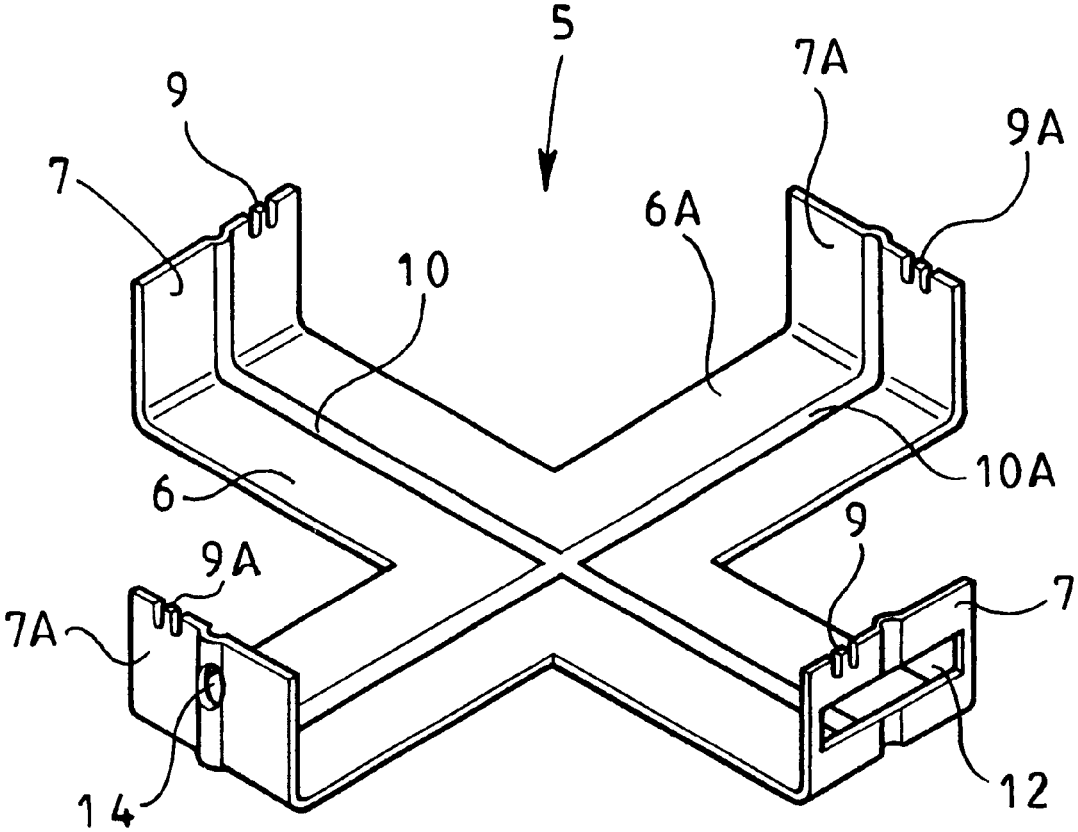
FIG. 4 is a perspective view of an alternative embodiment of reinforcing means for application to the dish-like component of FIG. 1.

Instead of the two strips 6, 7; 6A, 7A being provided as separate components crossing one another, they may be provided as limbs of a single integral cross-shaped component as shown in FIG. 4.

Portions 9, 9A are cut out of the ends 7, 7A of the strips and deformed so as to extend into or over the peripheral wall 3 of the dish-like component 1. The reinforcing means 5 comprising the strips 6, 7; 6A, 7A is thereby secured to the dish-like component 1.

In order to stiffen the strips 6, 7; 6A, 7A, they may be provided with one or more ribs 10, 10A, preferably running longitudinally along the strips.

A terminal block 11 is secured to one of the end portions 7, of the strip 6, 7 and is connected through an aperture 12 and a corresponding aperture in the peripheral wall 3 of the dish-like member 1 to the at least one heating element 4.

Figure 3:
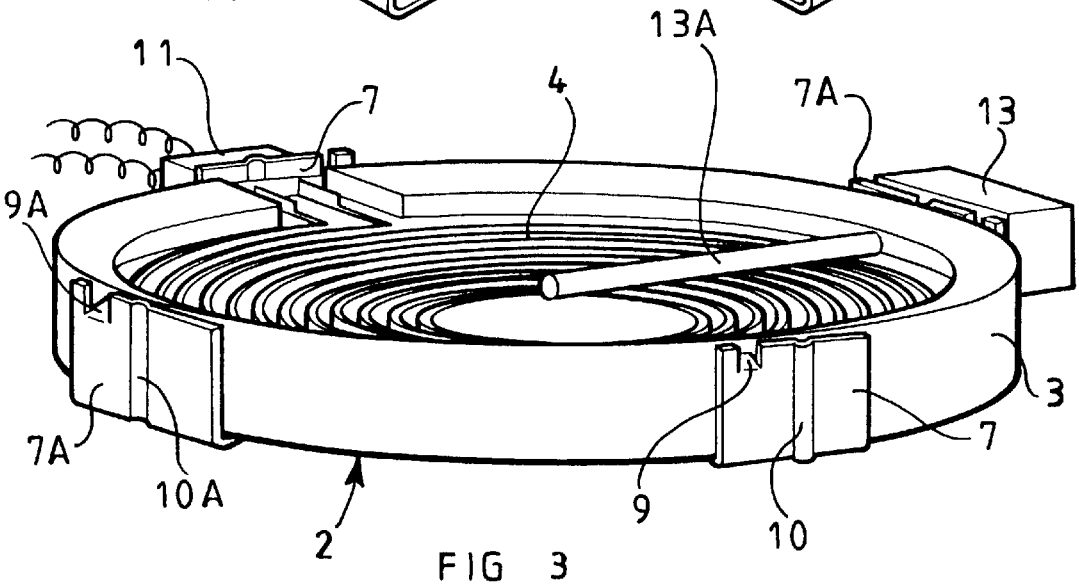
FIG. 3 is a perspective view of a radiant electric heater according to the present invention and incorporating the component and reinforcing means of FIGS. 1 and 2.

A temperature limiting device 13 is secured either at the opposite end of the same strip 6, 7 as the terminal block 11 or, as shown in FIG. 3, at one of the ends 7A of the other strip 6A, 7A. The temperature limiting device 13, which is of well-known form, has a rod-like portion 13A extending partly across the dish-like member 1, over the at least one heating element 4, through an aperture 14 in the end portion 7A of the strip of the reinforcing means and through a corresponding aperture in the peripheral wall 3 of the dish-like component 1.

As a result of the invention, the reinforcing means 5 provides inexpensive structural support for the dish-like component 1 of thermal insulation material as well as providing secure mountings for the terminal block 11 and temperature limiting device 13.

What is claimed is:

1. A radiant electric heater comprising a dish-like component of thermal insulation material having a base and an upstanding peripheral wall, at least one heating element supported inside the dish-like component, and reinforcing means secured to the dish-like component outside thereof, wherein the reinforcing means comprises at least one strip extending across the base and at least partly up the peripheral wall of the dish-like component, the reinforcing means being substantially continuously in contact with the dish-like component across the base thereof.

2. A radiant electric heater according to claim 1, wherein the at least one strip has opposite ends thereof extending at least partly up the peripheral wall.

3. A radiant electric heater according to claim 1, wherein the reinforcing means comprises at least two strips extending at an angle to one another across the base and at least partly up the peripheral wall of the dish-like component.

4. A radiant electric heater according to claim 3, wherein two strips are arranged substantially orthogonal to one another.

5. A radiant electric heater according to claim 3, wherein the at least two strips are provided as separate components crossing one another.

6. A radiant electric heater according to claim 3, wherein the at least two strips are secured to one another.

7. A radiant electric heater according to claim 3, wherein the at least two strips are provided as limbs of a single integral component.

8. A radiant electric heater according to claim 1, wherein a terminal block is secured to the reinforcing means.

9. A radiant electric heater according to claim 8, wherein the terminal block is secured to at least one portion of the at least one strip of the reinforcing means which extends at least partly up the peripheral wall.

10. A radiant electric heater according to claim 1, wherein a temperature limiting device is secured to the reinforcing means.

11. A radiant electric heater according to claim 10, wherein the temperature limiting device is secured to at least one portion of the at least one strip of the reinforcing means which extends at least partly up the peripheral wall.

12. A radiant electric heater according to claim 1, wherein the at least one strip of the reinforcing means is secured to the dish-like component at the peripheral wall thereof.

13. A radiant electric heater according to claim 12, wherein the reinforcing means is secured to the dish-like component by means of a deformed portion of the at least one strip extending towards the peripheral wall.

14. A radiant electric heater according to claim 13, wherein the deformed portion comprises a cut out deformed portion of the at least one strip extending towards the peripheral wall.

15. A radiant electric heater according to claim 1, wherein the at least one strip of the reinforcing means incorporates at least one stiffening rib.

16. A radiant electric heater according to claim 15, wherein the at least one stiffening rib runs longitudinally along the at least one strip.

17. A radiant electric heater according to claim 1, wherein the reinforcing means comprises metal.

18. A radiant electric heater according to claim 1, wherein the thermal insulation material of the dish-like component comprises compacted microporous thermal insulation material.

* * * * *